US005246139A

United States Patent [19]

Duceppe

[11] Patent Number: 5,246,139

[45] Date of Patent: Sep. 21, 1993

[54] BI-COMPARTMENTALIZED CONTAINER FOR STORING AND DISPENSING MATERIAL

[76] Inventor: Antoine Duceppe, 6472 Boul. des Roseraies, Ville D'Anjou, Quebec, Canada, H1M 2S2

[21] Appl. No.: 736,940

[22] Filed: Jul. 29, 1991

[51] Int. Cl.[5] ..... G01F 11/00

[52] U.S. Cl. ..... 222/1; 215/364; 222/130; 222/142.5; 222/187; 222/207; 222/554; 401/202

[58] Field of Search ..... 222/129, 130, 142.1, 222/142.5, 187, 207, 554; 132/73.5, 74.5, 75; 215/364; 401/196, 122, 202

[56] References Cited

U.S. PATENT DOCUMENTS

| | | | |
|---|---|---|---|
| 2,975,464 | 3/1961 | Schultz | 222/187 X |
| 4,106,673 | 8/1978 | Donoghue | 222/215 X |
| 4,214,679 | 7/1980 | Whang | 222/158 |
| 4,282,891 | 8/1981 | Duceppe | 132/73.5 |
| 4,466,452 | 8/1984 | Ferrari | 132/75 |
| 4,474,195 | 10/1984 | Warner | 132/75 X |
| 4,474,312 | 10/1984 | Donoghue | 222/207 X |
| 4,530,726 | 7/1985 | Montiel | 132/73.5 X |
| 4,756,433 | 7/1988 | Lin | 215/6 |
| 4,964,372 | 10/1990 | Zeenni et al. | 132/74.5 |
| 5,065,778 | 11/1991 | Terrell | 132/74.5 |

FOREIGN PATENT DOCUMENTS

| | | |
|---|---|---|
| 838800 | 6/1960 | United Kingdom . |
| 2236094 | 3/1991 | United Kingdom . |

*Primary Examiner*—Andres Kashnikow
*Assistant Examiner*—Joseph A. Kaufman
*Attorney, Agent, or Firm*—Foley & Lardner

[57] ABSTRACT

A container is provided for storing and dispensing materials such as liquids or powders, having a first compartment having a first end and side walls, and a second compartment disposed within the first end of the first compartment such that a gap exists between an outer wall of the second compartment and the side wall portion of the first compartment, with the gap being wide enough for material to pass therethrough. The container can be squeezed, inverted or shaken to force an amount of material from the first compartment and into the second compartment through the gap. The second compartment may be friction fit or snap fit within the first end of the first compartment, while retaining the gap between the outer wall of the second compartment and the side wall portion of the first compartment. The container further has a lid for closing and opening the container, and a plug disposed with the lid, such that when the container is closed, the plug is inserted into the second compartment to control the level of material which is retained in the second compartment.

3 Claims, 2 Drawing Sheets

BI-COMPARTMENTALIZED CONTAINER FOR STORING AND DISPENSING MATERIAL

BACKGROUND OF THE INVENTION

1. Field of the Invention

The present invention relates to a container for storing and dispensing materials, such as liquids and powders.

2. Discussion of the Related Art

Liquids or powders such as cooking oil, baby powder, fingernail polish remover, and jewelry cleaner are often stored in containers which provide for dispensing the liquid into a separate container or onto cloth or cotton balls before use. Thus, there is always the possibility of spillage of the material at some time during the dispensing process. In addition, the prior art containers lack any compartment which provides for the premeasuring and retaining an amount of material which is dispensed for each particular application.

Accordingly, a number of containers have been previously proposed to eliminate or reduce the spillage which typically results from these prior containers. For example, Duceppe, U.S. Pat. No. 4,282,891, discloses a cylindrical, flat-bottomed container having a removable cover for holding fingernail polish remover. A sponge pad having a centrally-located finger receiving means is disposed within the container. Fingernail polish remover is absorbed by the sponge, so that upon insertion of the finger into the finger receiving hole and rotation of the finger, the inner surface of the finger receiving hole aids in removing fingernail polish from the fingernail This avoids the need for special brushes for removing the fingernail polish. The container, however, has suffered the disadvantage that the fingernail polish remover must be periodically poured into the container to replace that which has been used. Thus, the device is not entirely self-contained and does not completely eliminate the spillage problem.

Zeenni and Duceppe, U.S. Pat. No. 4,964,372 illustrates a container having first and second compartments, with a liquid metering valve dividing the two compartments. The second compartment has squeezable side walls whereby, upon squeezing, an amount of liquid is supplied to the first compartment to fill a liquid absorbing sponge with liquid nail polish remover. However, with the Zeenni/Duceppe container, a separate mechanical device is needed to force material from the second compartment into the first compartment, or the first compartment must have a slit or hole for receiving liquid from the second compartment. Thus, if problems arise with the metering valve, the function of the container is reduced to that of the prior art containers, and the first compartment cannot be used to retain the specific amount of liquid to be dispensed, and the spillage problem continues with the second compartment. Furthermore, since the first compartment must have a hole or slit to receive the valve or liquid directly, it could never serve as a storage compartment to retain a premeasured amount of material for future use.

SUMMARY OF THE INVENTION

Accordingly, it is an object of the present invention to provide a bi-compartmentalized container which includes a non-mechanical means for forcing material from the first compartment into the second compartment, without forming a slit or hole in the bottom of the second compartment, with the first compartment having an opening for receiving the second compartment.

It is a further object of the present invention to provide a lid for closing and opening the container. A plug is disposed within the lid, whereby when the container is closed, the plug is inserted in the second compartment to control the level of material which is retained in the second compartment.

It is another object of the present invention to provide a container wherein the material may be replenished in the second compartment by squeezing the side walls of the first compartment.

It is still a further object of the present invention to provide a container wherein the material may be replenished in the second compartment by inverting and/or shaking the container.

Yet another object of the present invention is to provide a bi-compartmentalized container for treating fingernails having a liquid absorbing member disposed in the second member, a finger receiving means defined within the liquid absorbing member, and a non-mechanical means for forcing an amount of liquid from the first compartment into the second compartment.

The foregoing and additional objects are obtained by providing a container for storing and dispensing materials such as liquids or powders, comprising a first compartment having a first end and side wall portion, and a second compartment disposed within the first end of the first compartment such that a gap exists between an outer wall of the second compartment and the side wall portion of the first compartment, with the gap being wide enough for material to pass therethrough. Means are also provided for forcing an amount of material from the first compartment and into the second compartment through the gap. The second compartment may be friction fit or snap fit within the first end of the first compartment, while retaining the gap between the outer wall of the second compartment and the side walls of the first compartment.

In a first embodiment the container further comprises a lid for closing and opening the container and a plug disposed within the lid, whereby when the container is closed, the plug is inserted into the second compartment to control the level of liquid which is retained in the second compartment.

In one embodiment the material is forced from the first compartment into the second compartment by squeezing the side wall portion of the first compartment. In another embodiment, the material is forced from the first compartment into the second compartment by shaking and/or inverting the container.

In the illustrated embodiment, the container is one for treating fingernails, and comprises a first compartment having a first end and side walls, a second compartment disposed within the first end of the first compartment such that a gap exists between an outer wall of the second compartment and side walls of the first compartment, the gap being wide enough for a liquid to pass therethrough, over the top edge of the second compartment and into the second compartment. A liquid absorbing member is disposed in the second compartment, with a finger receiving means defined within the liquid absorbing member. Means are provided for forcing an amount of liquid fingernail polish remover from the first compartment and into the second compartment through the gap.

Further objects and advantages of the present invention will become apparent to those of skill in the art from the drawings and specification which follow.

DETAILED DESCRIPTION OF THE PREFERRED EMBODIMENTS

Figure 1:
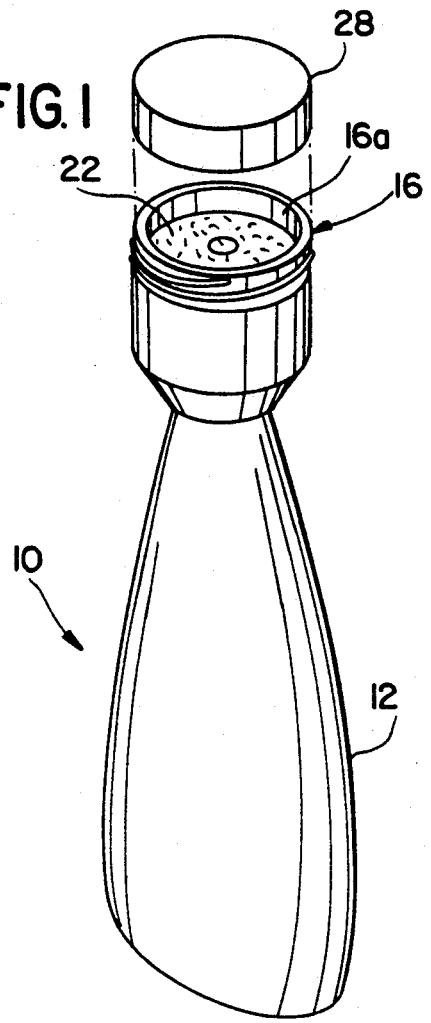
FIG. 1 is a perspective view of a first embodiment of a container according to a preferred embodiment of the present invention.
Figure 2:
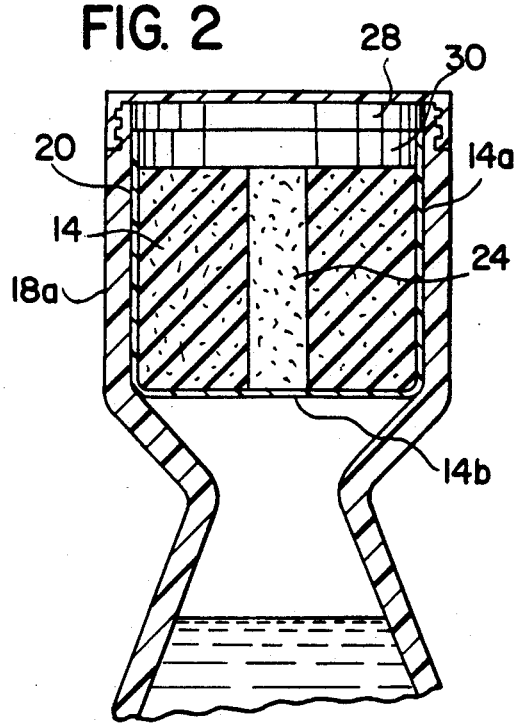
FIG. 2 is a partial vertical cross-section of the container according to the preferred embodiment of the present invention.
Figure 3:
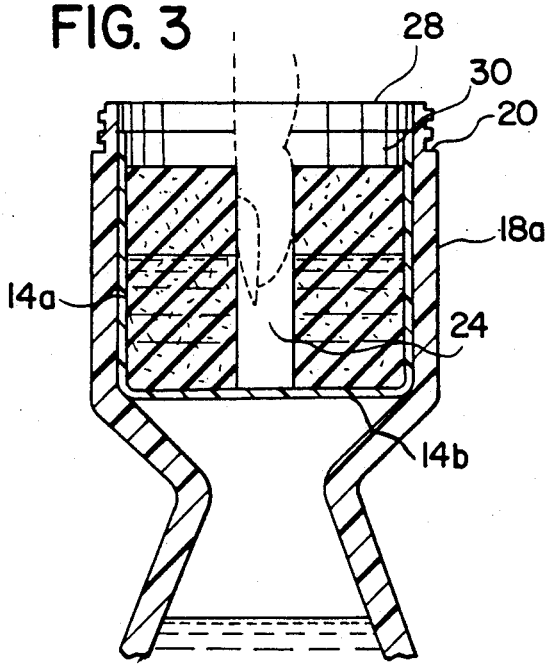
FIG. 3 is a partial vertical cross-section of the container in use.
Figure 4:
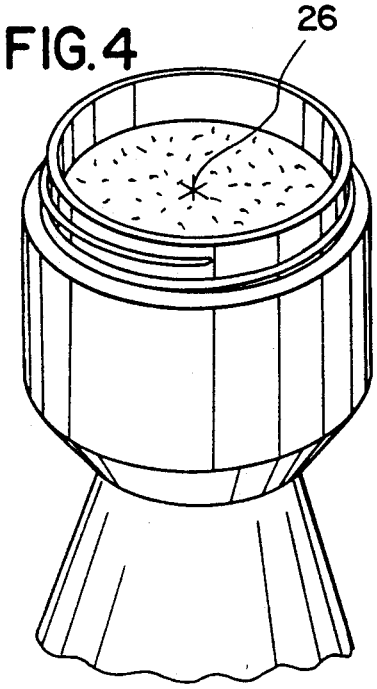
FIG. 4 is a top perspective view of the container.

The present invention, as illustrated in FIGS. 1 and 2, contemplates a fingernail treating container, designated generally by the reference numeral 10 having a first lower compartment 12 and a second upper compartment 14. As shown in FIGS. 1 and 2, t he lower compartment 12 has a first end portion 16 which includes an opening 16*a* and side wall portion 18*a*. As illustrated, the upper compartment 14 is disposed within opening 16*a* in the first end of compartment 12, such that a gap 20 exists between outer walls 14*a* of the upper compartment and the side wall portion 18*a* of the first end of the lower compartment with the corner of bottom wall portion 14*b* grasping the side wall portion 18*a*. The upper compartment 14 may be friction fit within the first end of the lower compartment as illustrated in FIG. 1, or can be snap fit. The lower compartment 12 is at least partially filled with liquid nail polish remover or other material. As seen in FIGS. 1–4, the upper compartment may contain a liquid absorbing sponge member 22 having defined therein a generally centrally located finger receiving hole 24. The finger receiving hole may advantageously be formed from a plurality of intersecting slits 26, as shown in FIG. 4. The upper compartment 14 is constructed generally as disclosed in U.S. Pat. No. 4,282,891, which is hereby incorporated by reference, except that in compartment 14, the bottom wall portion 14*b* is completely solid without any holes or slits.

Referring now to FIG. 2, there is shown a partial cross-section of the upper compartment of a fingernail polish removing device according to the present invention. As shown in this figure, a removable lid 28 is threadably disposed atop the upper compartment 14. As shown in FIG. 2, disposed within this upper lid 28 is a plug 30. The plug 30 serves to retain the level of material which is stored in the upper compartment. For example, upon screwing the lid onto the top of the upper compartment 14, the plug 30 is forced into the upper compartment, thereby retaining the level of fluid or other material in the upper compartment.

Figure 2A:
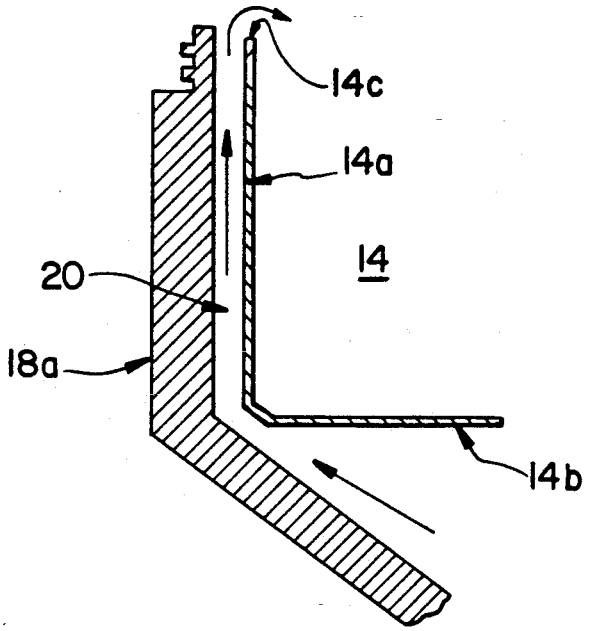
FIG. 2*a* (not drawn to scale) is an enlargement of a section of the preferred embodiment of the invention.

The lower compartment 12 may be formed from a squeezable material such as soft plastic so that upon squeezing the lower side walls of the lower compartment 12, nail polish remover or other material is forced to flow, as shown in FIG. 2*a* (not drawn to scale—arrows indicating direction of flow) from the lower compartment 12, through the gap 20, over the top edge of the upper compartment 14*c*, and into the upper compartment 14, and thereby soaking the sponge 22 with material. The lower compartment 12 may also be formed from glass or other material, such that upon inverting and/or shaking the container, material such as nail polish remover is forced to flow from the lower compartment 12, through the gap 20 and into the upper compartment 14. After using the upper compartment to dispense the polish remover by inserting a finger into finger receiving hole 24, the lid can be placed on top of the container 10, screwed on to upper compartment 14 and plug 30 inserted into the upper compartment to retain the amount of material needed for future applications.

It should become obvious to those skilled in the art that this invention is not limited to the preferred embodiments shown and described. For example, the upper and lower compartments of the container may take on many different shapes. Additionally, the container may be used to store and dispense various types of material such as liquids or powders, and depending upon the application, the liquid absorbing member may not be necessary.

What is claimed is:

1. A method for treating fingernails comprising the steps of:

providing a container having a first compartment having a bottom end, squeezable sidewalls and a completely open top, a second separate and removable compartment, having a top edge and being completely closed except surrounding the top edge, the second compartment being disposed within the open top of the first compartment such that the second compartment completely closes off the top of the first compartment and a gap exists between an outerwall of said second compartment and the sidewall portion of said first compartment, the gap being wide enough for liquid to pass therethrough;

placing a liquid absorbing member within said second compartment;

at least partially filling said first compartment with the liquid;

providing the liquid absorbing member with a finger receiving means;

forcing an amount of the liquid from said first compartment into said second compartment such that said fluid flows only and directly from the first compartment through the gap, over the top edge of said second compartment and into said second compartment;

covering the container with a liquid having a plug disposed therein, such that the plug compresses the liquid absorbing member contained in the second compartment thereby limiting the amount of fluid retained during the forcing step; and inserting at least the end of the finger into the finger receiving means to treat the fingernail.

2. A method for treating fingernails as recited in claims 1, wherein the forcing step comprises inverting said container to force the liquid from said first compartment through the gap and into said second compartment.

3. A method for treating fingernails as recited in claim 1, wherein the forcing step comprises squeezing the sidewalls of said first compartment to force the liquid through the gap and into the second compartment.

* * * * *